US006523717B1

(12) United States Patent
Willemsen

(10) Patent No.: US 6,523,717 B1
(45) Date of Patent: Feb. 25, 2003

(54) APPARATUS FOR DISPENSING A POROUS CARRIER

(75) Inventor: Louis R. H. A. Willemsen, Dorst (NL)

(73) Assignee: Weasy Pack B.V., Oosterhout (NL)

( * ) Notice: Subject to any disclaimer, the term of this patent is extended or adjusted under 35 U.S.C. 154(b) by 0 days.

(21) Appl. No.: 09/743,042

(22) PCT Filed: Jul. 5, 1999

(86) PCT No.: PCT/NL99/00420

§ 371 (c)(1),
(2), (4) Date: May 7, 2001

(87) PCT Pub. No.: WO00/01271

PCT Pub. Date: Jan. 13, 2000

(30) Foreign Application Priority Data

Jul. 7, 1998 (NL) ..... 1009581

(51) Int. Cl.[7] ..... B65G 59/00
(52) U.S. Cl. ..... 221/267; 221/307
(58) Field of Search ..... 221/267, 307, 221/279, 280, 310; 401/175, 63, 196, 57, 86, 261

(56) References Cited

U.S. PATENT DOCUMENTS 1,662,857 A 3/1928 Heiter
2,813,289 A 11/1957 Even
2,841,809 A 7/1958 Oliver
4,699,161 A * 10/1987 Smith et al. ..... 132/73.5
4,854,761 A * 8/1989 Smith et al. ..... 401/196

* cited by examiner

*Primary Examiner*—Kenneth W. Noland
(74) *Attorney, Agent, or Firm*—Banner & Witcoff, Ltd.

(57) ABSTRACT

The invention relates to an apparatus for dispensing or releasing a porous carrier wherein the apparatus comprises: a supply chamber for the porous carrier; and ejection means for causing the carrier to move gradually outside the supply chamber. According to another preferred embodiment the ejection means comprise an outlet opening which is arranged in the end wall of the supply chamber and the dimension of which is such that the porous carrier moves through the outlet opening only when the ejecting body is operated. Thus is achieved that the carrier is not accidentally moved outward to an excessive degree. According to a particularly important embodiment the porous carrier is divided into separate elements in lengthwise direction and the elements move through the outlet opening one by one when the ejecting body is operated. This enables use of separate elements in the form of the cotton wool pads typical in this field.

20 Claims, 3 Drawing Sheets

APPARATUS FOR DISPENSING A POROUS CARRIER

FIELD OF THE INVENTION

The present invention relates to an apparatus for dispensing or releasing a porous carrier.

BACKGROUND OF THE INVENTION

Such porous carriers find wide application in cosmetics, for instance as carrier for liquid with which nail varnish is removed, as carrier for cleaning fluid for the face, as carrier for applying powder to the face and so on.

Use is usually made of wads of cotton wool as carrier, for instance in the form of cotton wool pads.

It is often awkward to get hold of such a cotton wool pad or other porous carrier. The present invention provides such an apparatus for this purpose which is provided with a supply chamber for the porous carrier and ejection means for causing the carrier to move gradually outside the supply chamber. It is possible herein to gradually move the carrier, which is seen here as one element, outside the supply chamber so that it can be provided with an auxiliary material and the auxiliary material can be applied to the face, or the auxiliary material can be used to remove impurities or for instance nail varnish.

BRIEF DESCRIPTION OF THE INVENTION

According to a first preferred embodiment the supply chamber is at least substantially cylindrical and the ejection means comprise an ejecting body which can be operated in longitudinal direction of the supply chamber and from outside the supply chamber.

This results in a structurally simply construction.

According to another preferred embodiment the ejection means comprise an outlet opening which is arranged in the end wall of the supply chamber and the dimension of which is such that the porous carrier moves through the outlet opening only when the ejecting body is operated. Thus is achieved that the carrier is not accidentally moved outward to an excessive degree.

According to a particularly important embodiment the porous carrier is divided into separate elements in lengthwise direction and the elements move through the outlet opening one by one when the ejecting body is operated.

This enables use of separate elements in the form of the cotton wool pads typical in this field.

In order to achieve better operation of the apparatus, the elements of the porous carrier are mutually separated by separating elements. Dispensing is hereby made easier.

This is particularly the case when the separating elements have a dimension such that they only move through the outlet opening when the ejecting body is operated and are otherwise held back by the end wall.

According to yet another preferred embodiment the elements of a porous carrier are each connected to the separating element lying above.

The firmness of the carrier is hereby manifestly strengthened.

According to yet another preferred embodiment the end wall is provided on its outer side with a holding element for holding the last carrier element moved through the outlet opening.

Other attractive preferred embodiments are specified in the remaining sub-claims.

BRIEF DESCRIPTION OF THE DRAWINGS

The present invention will be elucidated hereinbelow with reference to the annexed figures, in which.

DETAILED DESCRIPTION OF THE INVENTION

Figure 1:
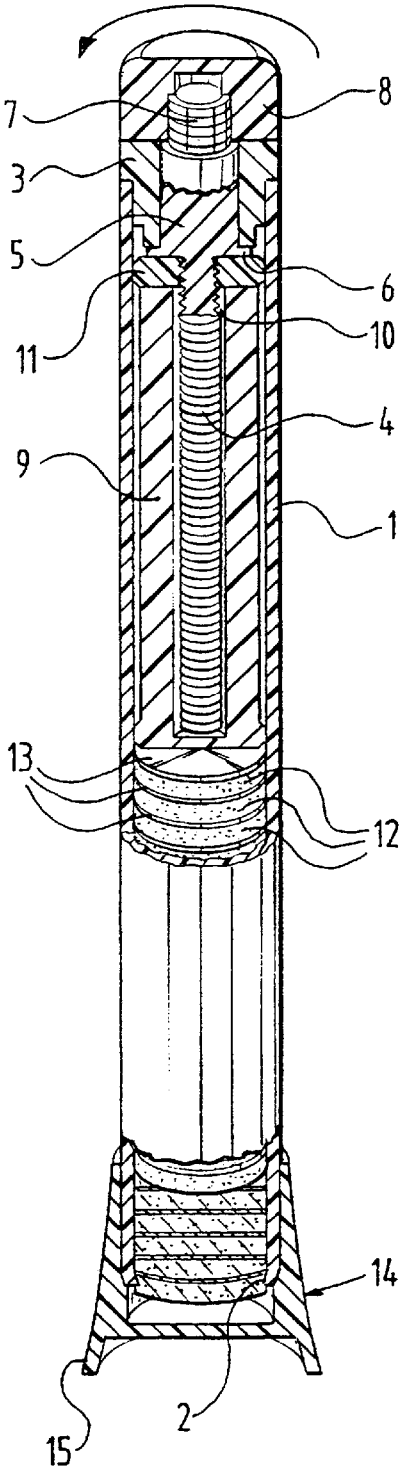
FIG. 1 shows a schematic perspective, partly cross-sectional view of a first embodiment of the present invention.

The apparatus according to the present invention is formed essentially by a cylindrical housing 1, on the underside of which is arranged an outlet opening 2. The walls of the cylindrical housing are here curved slightly towards each other, so that outlet opening 2 has a slightly smaller diameter than the internal diameter of the rest of cylindrical housing 1. The other end of cylindrical housing 1 is closed by a cap 3 connected to cylindrical housing 1 by means of for instance glueing or welding.

Arranged in cap 3 concentrically to cylindrical housing 1 is a cylindrical opening through which extends a screw spindle 4. The screw spindle is widened at the location of cap 3 to form a cylindrical part 5. The cylindrical part 5 is provided on its underside with a widened portion 6. Screw spindle 4 with cylindrical part 5 and widened portion 6 can rotate freely relative to cap 3. On its top the cylindrical part 5 is closed by a piece 7 provided with screw thread. A screw cap 8 is screwed onto the part 7 provided with screw thread. It is thus possible to rotate screw spindle 4 by rotating screw cap 8 from the outside. An axial movement of screw spindle 4 is on the other hand not possible.

A substantially cylindrical ejecting body 9 is arranged in the interior of and concentrically to cylindrical housing 1. Arranged in the interior of ejecting body 9 is a cavity 10 through which screw spindle 4 extends. Ejecting body 9 is closed at the top by a round nut 11. The round nut 11 takes a widened form so as to prevent rotation of round nut 11 relative to housing 1. It is otherwise also possible to embody the round nut octagonally or the like, wherein the inner wall of cylindrical body 1 must be shaped accordingly. What is essential is that when screw cap 8 is rotated the round nut 11 will move downward and thereby the ejecting body will likewise be caused to move axially downward The interior of cylindrical housing 1 is filled with carrier elements 11. Carrier elements 11 are mutually separated by separating elements 13.

The carrier elements are for instance formed by cotton wool pads which are mutually separated by the separating elements in the form of cardboard or plastic discs 13.

It is possible instead to make use of a carrier element consisting of one whole. The carrier element will herein be moved slowly outward when screw cap 8 is rotated. It is herein possible to tear off the desired quantity of the carrier element.

Usually however, separate elements 12 will be used which may be adhered to the separating element 13 lying above. It is also possible to embody separating elements 13 as individual elements.

The apparatus described up to this point is placed on a cover 14, although this is not essential for the invention. This cover 14 fits clampingly round the cylindrical housing at the location of outlet opening 2. In the present case the cover is formed such that it is provided with a widened annular foot 15 so that cover 14 can serve as a stand for cylindrical housing 1.

Figure 2:
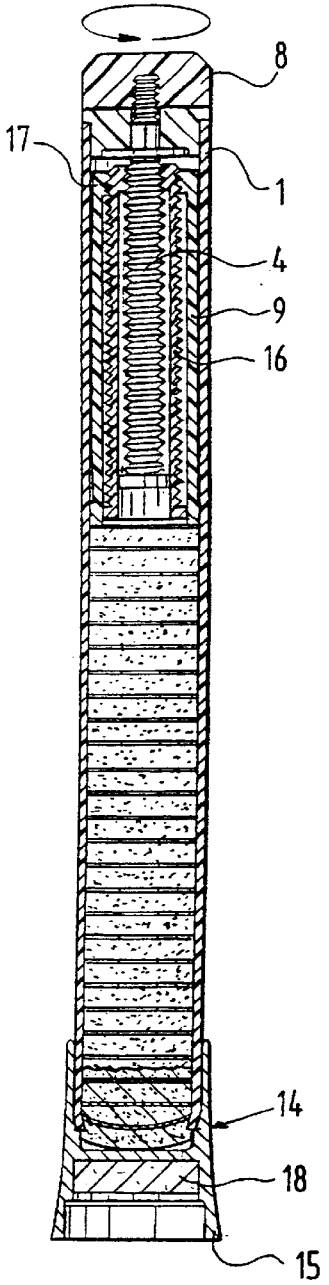
FIG. 2 is a cross-sectional view of the embodiment shown in FIG. 1, wherein additional containers are used.
Figure 2:
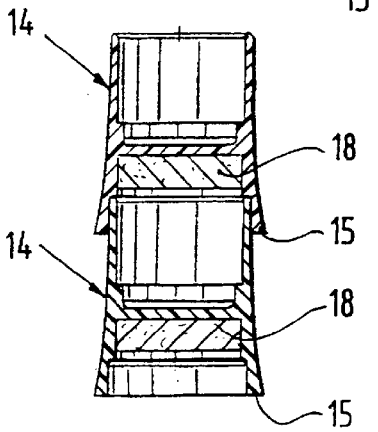
Figure 3:
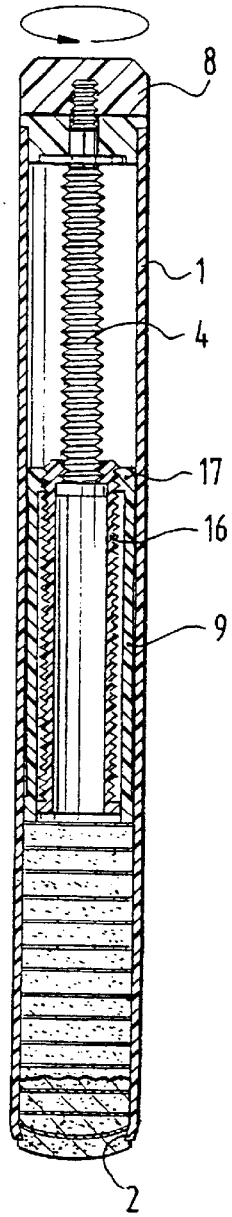
FIG. 3 shows a view corresponding with FIG. 2 in another situation of outward movement.

FIG. 2 shows a second embodiment of the invention. This second embodiment differs in that the coupling between screw cap 8 and ejecting body 9 is embodied differently. In this embodiment shown in FIG. 2 the screw cap 8 is connected to a screw spindle 4, which spindle 4 is connected to a telescopic body 16. This latter is provided with an opening provided with screw thread through which screw spindle 4 extends. When screw cap 8 is rotated screw spindle 4 will rotate and subsequently cause displacement of telescopic body 16 in axial direction. Telescopic body 16 is connected to ejecting body 9 so that in the case of axial displacement of telescopic body 16 the ejecting body 9 is displaced in axial direction. This movement can be continued until the situation shown in FIG. 3 is reached. Telescopic body 16 is herein rotated to its extreme position. Further rotation of screw cap 8 and therewith of screw spindle 4 will therefore result in co-rotation of telescopic body 16 since screw spindle 4 is screwed tight relative to telescopic body 16.

Telescopic body 16 is provided on its outside with screw thread which is engaged by a nut 17 connected to ejecting body 9 Further rotation of screw cap 8 will therefore result in co-rotation of telescopic body 16, whereafter ejecting body 9 is displaced further in axial direction as a consequence of the screw thread engagement between telescopic body 16 and nuts 17 forming part of ejecting body 9.

Figure 4:
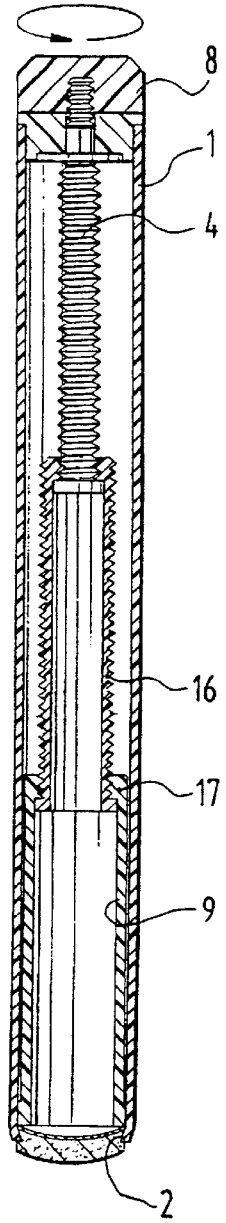
FIG. 4 shows a view corresponding with FIG. 3 in a subsequent situation of outward movement.

A relevant rotation movement can be continued until the situation shown in FIG. 4 is reached and ejecting body 9 has been urged to its extreme position.

This telescopic construction has the advantage that about two-thirds of the total length of the cylindrical housing can be formed with carrier elements 12. In the original situation shown in FIG. 1 this amounts to only about half.

This will of course entail a slightly more complicated mechanism.

The embodiment shown in FIG. 2 further differs from the embodiment shown in FIG. 1 in that the cover 14 placed thereon is provided on its underside with a cavity 18. Cavity 18 is open but can be closed by a lid. The relevant space in cavity 18 can be filled with a powdery material which can be applied using the carrier elements.

It is possible with relevant appropriate design of the inside of annular foot 15 to arrange several such covers one below another, each filled for instance with a material for applying in a different colour.

Figure 5:
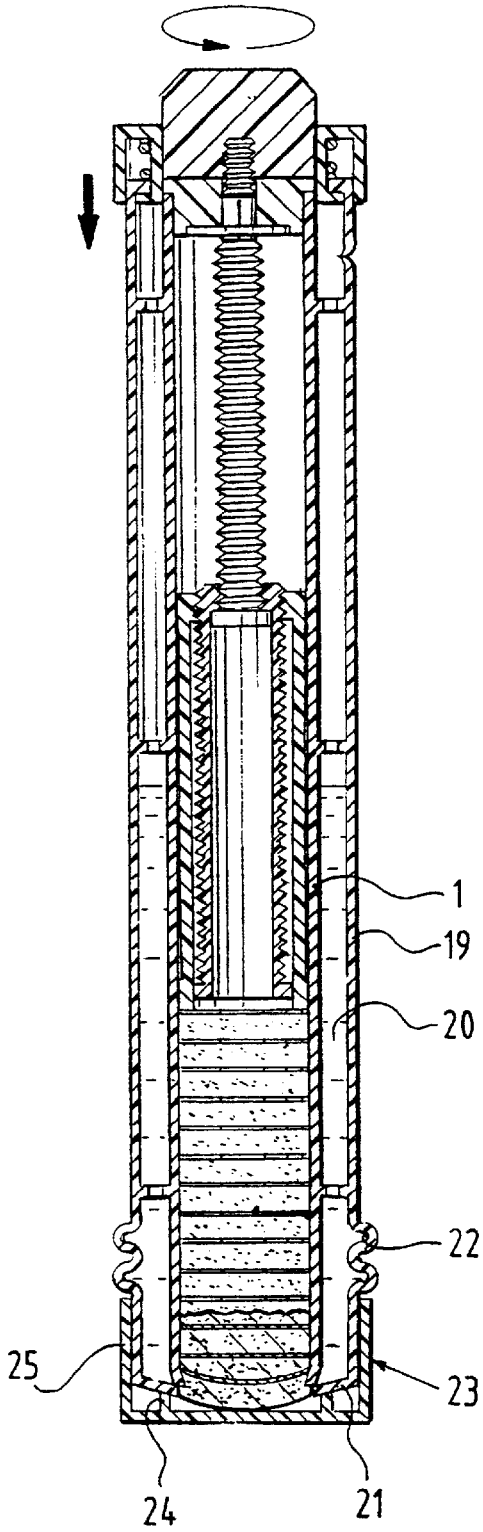
FIG. 5 shows a cross-sectional view of a second embodiment of the present invention.

Finally, FIG. 5 shows an embodiment wherein a cylindrical outer housing 19 is arranged around cylindrical housing 1 and the cylinder jacket-shaped space 20 present between the two housings is suitable for containing a liquid.

Outer housing 19 extends at the bottom to a position just short of outlet opening 2. Here the outer housing 19 is provided with an internal ring 21 which connects onto the ring around outlet opening 2.

The outer housing is further provided with two annular protrusions 22 whereby it is possible to exert a certain degree of spring force on ring 21 so that feed of the liquid present inside the space 20 in question can take place.

In order to prevent drying out, the whole can be closed by a cap 23, which is provided with a ring 24 for pressing ring 21 into the closed position. The cap further comprises a ring 25 which fits closely around the outside of outer housing 19.

It is otherwise also possible for carrier elements already impregnated beforehand with for instance alcohol to be accommodated in the housing.

As stated, space 20 can be filled with a liquid for applying, for instance a nail varnish remover such as acetone. The outer application element can then be moistened when outer housing 19 is depressed in axial direction, whereafter the nail varnish can be removed. It will be apparent that other liquids suitable for different purposes can be used.

Figure 6:
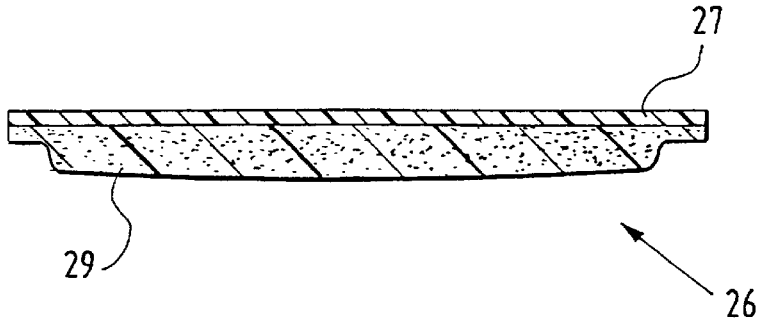
FIG. 6 shows a cross-sectional view of a first embodiment of a carrier element according to the present invention.
Figure 7:
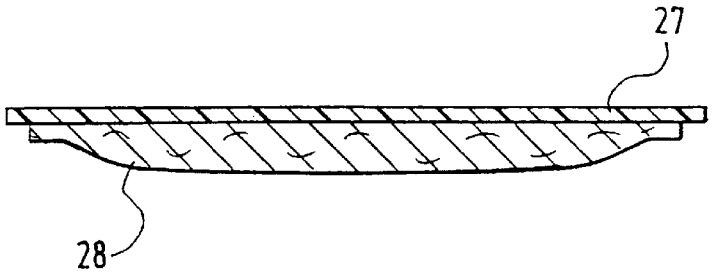
FIG. 7 shows a view corresponding with FIG. 6 of another embodiment of a carrier element according to the present invention.
Figure 8:
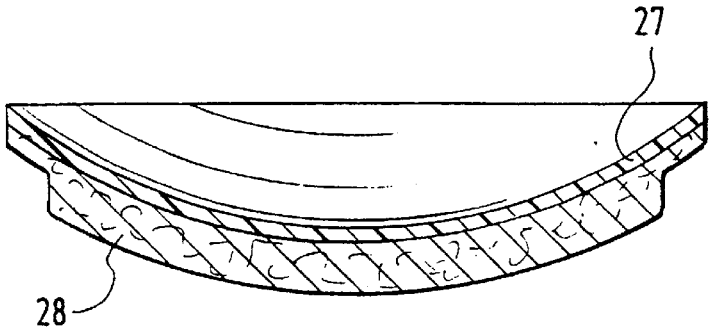
FIG. 8 is a perspective view of the carrier element shown in FIG. 7.

Finally, FIGS. 6, 7 and 8 show two different embodiments of carrier elements.

Shown in FIG. 6 is a carrier element 26 which is formed by a cardboard disc 27 on which a layer of cotton wool 28 is arranged, while FIG. 7 shows an embodiment wherein the layer of cotton wool is replaced by a layer of sponge-like plastic. It is otherwise also possible to use carrier elements not provided with a layer of cardboard or a layer of plastic, for instance when they have sufficient firmness of themselves.

FIG. 8 finally shows a partly perspective view of the carrier element depicted in FIG. 7, which is manufactured from "fluff".

According to an embodiment not shown in the drawings, driving of the ejecting body takes place in that:

the ejection means comprise a threaded guide arranged in the housing, the ejecting body is provided with engaging means for engaging the threaded guide, and rotation means are arranged for causing the ejecting body to rotate.

This mechanism is known inter alia from lipstick.

It will be apparent that diverse modifications an be made to the invention, particularly in respect of design. Instead of a round cross-section the invention an thus have for instance a square, oval or triangular cross-section.

What is claimed is:

1. Apparatus for dispensing porous carrier elements, wherein the apparatus comprises:

a substantially cylindrical supply chamber for the porous carrier elements;

ejection means for ejecting the porous carrier elements from the supply chamber in its longitudinal direction;

wherein the ejection means comprise an outlet opening arranged in an end wall of the supply chamber;

wherein the cross section of the outlet opening is smaller than the cross section of the supply chamber;

wherein each of the porous carrier elements comprises a rigid separating element;

wherein the separating elements have a dimension in a direction perpendicular to the longitudinal direction of the apparatus which is slightly longer than the dimension of the outlet opening in the same direction, such that they only move through the outlet opening when the ejecting body is operated and are otherwise held back by the end wall; and wherein the separating elements bulge under the action of the ejecting body before they are released.

2. Apparatus as claimed in claim 1, wherein the ejecting body is connected by means of at least one body provided with screw thread to a rotatable body arranged on the apparatus.

3. Apparatus as claimed in claim 2, wherein the rotatable body and the ejecting body are mutually connected by two sequentially functioning bodies provided with screw thread.

4. Apparatus as claimed in claim 1, wherein:

the ejection means comprise a threaded guide arranged in the housing, the ejecting body is provided with engaging means for engaging the threaded guide, and rotation means are arranged for causing rotation of the ejecting body.

5. Apparatus as claimed in claim 4, wherein the elements of the porous carrier are each connected to the separating element lying above.

6. Apparatus as claimed in claim 5, wherein the end wall is provided on its outer side with a holding element for holding the last carrier element moved through the outlet opening.

7. Apparatus as claimed in claim 1, wherein the apparatus is provided with dispensing means for supplying an auxiliary material to the porous carrier.

8. Apparatus as claimed in claim 7, wherein the auxiliary material is a liquid and that the dispensing means are adapted to supply liquid from a tank to the last carrier element moved through the outlet opening.

9. Apparatus as claimed in claim 8, wherein the dispensing device can be operated by an operating element which can be controlled from outside.

10. Apparatus as claimed in claim 9, wherein the tank is cylindrical and that its axis extends substantially parallel to the axis of the supply chamber.

11. Apparatus as claimed in claim 10, wherein the tank is cylinder jacket-shaped and extends around the supply chamber.

12. Apparatus as claimed in claim 7, wherein the dispensing means comprise a separate tank which is releasably connected to the apparatus.

13. Apparatus as claimed in claim 8, wherein the auxiliary material is a substantially solid, powdery substance and the tank is adapted to contain the substantially solid, powdery substance.

14. Apparatus as claimed in claim 13, wherein the auxiliary material is a liquid and the tank is provided with a releasable cap.

15. Apparatus as claimed in claim 14, wherein the carriers and the liquid are suitable for removing nail varnish.

16. Apparatus as claimed in claim 1, wherein the apparatus is suitable for dispensing a volatile liquid and that the apparatus is provided with a cap.

17. Apparatus as claimed in claim 12, wherein the apparatus can be coupled to at least two tanks.

18. Apparatus as claimed in claim 17, wherein the tanks can each be coupled to the apparatus and that the tanks are mutually connectable.

19. Apparatus as claimed in claim 16, wherein the apparatus can be coupled to at least two tanks.

20. Apparatus as claimed in claim 19, wherein the tanks can each be coupled to the apparatus and that the tanks are mutually connectable.

* * * * *